US010337179B2

(12) United States Patent
McAlpine

(10) Patent No.: US 10,337,179 B2
(45) Date of Patent: Jul. 2, 2019

(54) FLOOD PREVENTION APPARATUS

(71) Applicant: McAlpine & Co. Ltd., Glasgow, Strathclyde (GB)

(72) Inventor: James Edward McAlpine, Paisley (GB)

(73) Assignee: McAlpine & Co. Ltd., Glasgow (GB)

( * ) Notice: Subject to any disclaimer, the term of this patent is extended or adjusted under 35 U.S.C. 154(b) by 0 days.

(21) Appl. No.: 15/493,396

(22) Filed: Apr. 21, 2017

(65) Prior Publication Data

US 2017/0306598 A1 Oct. 26, 2017

(30) Foreign Application Priority Data

Apr. 26, 2016 (GB) ..... 1607202.7

(51) Int. Cl.
*E03C 1/24* (2006.01)
*E03C 1/26* (2006.01)
*E03C 1/232* (2006.01)

(52) U.S. Cl.
CPC ..... *E03C 1/24* (2013.01); *E03C 1/232* (2013.01); *E03C 1/26* (2013.01)

(58) Field of Classification Search
CPC ... E03C 1/24; E03C 1/232; E03C 1/26; E03C 1/2306; A47K 1/14
(Continued)

(56) References Cited

U.S. PATENT DOCUMENTS 112,621 A 3/1871 Nott
149,489 A 4/1874 Lewis
(Continued)

FOREIGN PATENT DOCUMENTS

AT 299824 7/1972
CH 636932 6/1983
(Continued)

OTHER PUBLICATIONS

EP2453065—english translation; machine generated May 2018.*
(Continued)

*Primary Examiner* — Benjamin R Shaw
(74) *Attorney, Agent, or Firm* — Colby Nipper PLLC

(57) ABSTRACT

A flood prevention apparatus for a sanitary ware product such as a bath or the like. The flood prevention apparatus comprises a multi chamber drain and an overflow apparatus. The multi chamber drain comprises a body defining at least a first and a second chamber therein. Openings into the body define a first outlet port and a second outlet port. Each of the first and second outlet ports are vertically and horizontally displaced relative to each other. The first outlet port is in fluid communication with the first chamber and the second outlet port is in fluid communication with the second chamber. The first and second outlet ports are each connectable to associated first and second pipe sections of the overflow apparatus. The overflow apparatus comprises a first pipe section configured to attach to the first outlet port and a second pipe section configured to attach to the second outlet port. The first and second pipe sections provide substantially vertical pipe sections. The first and second pipe sections are joined in continuous fluid communication by an inverted U-shaped passage, which includes a normally open air valve at its summit. The air valve is operable to control flow of water through the apparatus in a non-siphonic state.

20 Claims, 3 Drawing Sheets

(58) Field of Classification Search
USPC ..... 4/681
See application file for complete search history.

(56) References Cited

U.S. PATENT DOCUMENTS 263,180 A * 8/1882 Jackson ..... E03C 1/24 4/680
267,156 A * 11/1882 Cooper ..... E03C 1/23 4/686
277,888 A 5/1883 Connolly
294,489 A 3/1884 McCloskey
332,911 A * 12/1885 Lane ..... E03C 1/232 4/681
340,202 A 4/1886 Edwards
526,666 A * 9/1894 Marquis ..... E03C 1/232 4/681
535,872 A 3/1895 Thomas
556,692 A 3/1896 Purves
640,666 A 1/1900 Knapp
765,697 A 7/1904 Bunting, Jr.
803,979 A 11/1905 Bonnell
851,513 A 4/1907 Guthrie et al.
875,587 A 12/1907 Morrison
877,309 A 1/1908 Emerson
951,795 A 3/1910 Berwanger
1,134,866 A * 4/1915 Kavanagh ..... E03C 1/24 4/628
1,274,578 A 8/1918 Nicholson
1,669,473 A 5/1928 Kelso
1,731,431 A 10/1929 Milton
1,751,877 A 3/1930 Nance
1,781,719 A 11/1930 Darling
1,848,521 A 3/1932 Fleck
1,958,712 A 5/1934 Nance
2,349,180 A 5/1944 Lamont
2,444,340 A 6/1948 Donahue
2,450,392 A 9/1948 Donahue
2,567,639 A 9/1951 Fulton
2,793,371 A 5/1957 Vesconte
3,047,013 A 7/1962 Baumbach
3,096,527 A 7/1963 Eynon
3,181,801 A 5/1965 Lung et al.
3,391,419 A 7/1968 Thorne-Thomsen
3,400,446 A 9/1968 Yulkowwski
3,428,295 A 2/1969 Downey et al.
3,430,871 A 3/1969 Ross
3,565,106 A 2/1971 Baumbach
3,583,003 A 6/1971 Thompson
3,651,826 A 3/1972 Kojima
3,855,649 A 12/1974 Morris et al.
3,911,508 A 10/1975 Goldberg
4,103,367 A 8/1978 Kaufer
4,158,897 A 6/1979 Cocherel
4,218,785 A 8/1980 Crawford
4,244,061 A 1/1981 Webster et al.
4,321,713 A 3/1982 Thompson
4,359,788 A 11/1982 Liou
4,546,503 A 10/1985 Casberg
4,594,739 A 6/1986 Watts et al.
4,692,948 A 9/1987 Martin
4,777,676 A 10/1988 Ericson
4,860,390 A * 8/1989 Ohta ..... A47K 1/14 4/287
4,870,992 A 10/1989 Irwin et al.
4,969,217 A * 11/1990 Gandini ..... E03C 1/232 4/686
5,039,135 A 8/1991 Palmer
5,121,509 A * 6/1992 Juple ..... E03C 1/232 4/669
5,165,118 A 11/1992 Cendrowski
5,265,281 A 11/1993 McAlpine
5,418,983 A 5/1995 Garguillo et al.
5,489,415 A 2/1996 Vlahaki
5,535,455 A 7/1996 Liu
5,662,138 A 9/1997 Wang
5,692,248 A 12/1997 Ball
5,711,037 A 1/1998 Richardt et al.
5,819,328 A 10/1998 Lewis
5,987,655 A 11/1999 Smet
6,044,859 A 4/2000 Davis
6,067,669 A 5/2000 Peterson
6,151,722 A 11/2000 Lubrano
6,173,459 B1 1/2001 Ball
6,195,819 B1 * 3/2001 Wang ..... A47K 1/14 4/287
6,401,266 B1 6/2002 Mitchell et al.
6,415,463 B1 7/2002 Slothower
6,450,544 B2 9/2002 Becker et al.
6,585,005 B1 7/2003 Raftis et al.
6,644,339 B2 11/2003 Gorges et al.
6,886,193 B2 5/2005 McAlpine
6,973,939 B2 12/2005 Gorges et al.
7,013,500 B1 3/2006 Lin
7,155,760 B2 1/2007 McAlpine
7,243,681 B2 7/2007 Dahm
7,575,022 B2 8/2009 Higgins
7,636,957 B2 12/2009 Funari
D715,405 S * 10/2014 McAlpine ..... D23/233
8,943,619 B2 2/2015 Romero
9,222,247 B2 12/2015 Muderlak et al.
9,683,359 B2 6/2017 McAlpine
9,790,672 B2 10/2017 McAlpine et al.
9,915,058 B2 3/2018 McAlpine
10,077,546 B2 9/2018 McAlpine
2002/0069913 A1 6/2002 Gorges et al.
2002/0189675 A1 12/2002 Huber
2003/0182721 A1 10/2003 Li
2003/0196262 A1 10/2003 McAlpine
2004/0049846 A1 3/2004 Cornwall
2004/0177439 A1 9/2004 Nunez
2006/0080763 A1 4/2006 McAlpine
2006/0195976 A1 9/2006 McAlpine
2006/0207005 A1 9/2006 Janssen
2007/0079874 A1 4/2007 McAlpine
2007/0186337 A1 8/2007 Emr
2008/0022455 A1 1/2008 McAlpine
2009/0260154 A1 * 10/2009 Shoop ..... E03C 1/232 4/680
2010/0005581 A1 1/2010 McAlpine
2010/0199412 A1 8/2010 McAlpine
2010/0205725 A1 8/2010 McAlpine
2011/0000014 A1 1/2011 Ball et al.
2013/0000766 A1 1/2013 McAlpine et al.
2013/0042405 A1 2/2013 Marotz et al.
2015/0299994 A1 * 10/2015 McAlpine ..... E03C 1/232 4/694
2017/0016220 A1 1/2017 McKendrick et al.
2017/0233990 A1 8/2017 McAlpine et al.
2017/0241115 A1 8/2017 McAlpine
2017/0284074 A1 10/2017 McAlpine

FOREIGN PATENT DOCUMENTS

DE 1815734 7/1969
DE 9301155 4/1993
DE 19915322 1/2001
DE 10037535 3/2002
DE 20118255 5/2002
DE 20118252 3/2003
DE 20302114 4/2003
DE 10261487 7/2004
DE 102006018019 10/2007
EP 0180451 5/1986
EP 0342819 4/1992
EP 1174549 1/2002
EP 1188870 3/2002
EP 1484453 12/2004
EP 1593784 11/2005
EP 1785077 11/2005
EP 1612337 1/2006
EP 1967665 9/2008
EP 1992746 11/2008
EP 2037051 3/2009
EP 2045403 4/2009

(56) References Cited

FOREIGN PATENT DOCUMENTS

| | | | | |
|---|---|---|---|---|
| EP | 2453065 | | 5/2012 | |
| EP | 2453065 | A2 * | 5/2012 | ..... E03C 1/232 |
| EP | 2660398 | | 3/2013 | |
| FR | 2164018 | | 7/1973 | |
| GB | 830734 | | 3/1960 | |
| GB | 856064 | | 12/1960 | |
| GB | 1125196 | | 8/1968 | |
| GB | 1220982 | | 1/1971 | |
| GB | 2070093 | | 9/1981 | |
| GB | 2174899 | | 11/1986 | |
| GB | 2285460 | | 7/1995 | |
| GB | 2319540 | | 5/1998 | |
| GB | 2321067 | | 7/1998 | |
| GB | 2329332 | | 3/1999 | |
| GB | 2373182 | | 9/2002 | |
| GB | 2334885 | | 11/2002 | |
| GB | 2423709 | | 9/2006 | |
| NL | 1032117 | | 1/2008 | |
| WO | 9907953 | | 2/1999 | |
| WO | 0177448 | | 10/2001 | |
| WO | 2004100742 | | 11/2004 | |
| WO | 2006043301 | | 4/2006 | |
| WO | 2007099356 | | 9/2007 | |
| WO | 2007110595 | | 10/2007 | |
| WO | 2008006234 | | 1/2008 | |
| WO | 2008144951 | | 12/2008 | |
| WO | 2009040524 | | 4/2009 | |
| WO | 2010107723 | | 9/2010 | |
| WO | 20100140761 | | 12/2010 | |
| WO | 2013184078 | | 12/2013 | |
| WO | 2014087151 | | 6/2014 | |
| WO | WO-2014087151 | A1 * | 6/2014 | ..... E03C 1/232 |

OTHER PUBLICATIONS

"Final Office Action", U.S. Appl. No. 15/512,779, dated Jul. 26, 2018, 13 pages.
"Final Office Action", U.S. Appl. No. 15/512,804, dated Aug. 2, 2018, 8 pages.
"Notice of Allowance", U.S. Appl. No. 15/467,625, dated Jun. 27, 2018, 5 pages.
"Advisory Action", U.S. Appl. No. 12/679,755, dated Mar. 11, 2016, 3 pgs.
"Advisory Action", U.S. Appl. No. 12/679,783, dated Jul. 8, 2015, 3 pgs.
"Advisory Action", U.S. Appl. No. 12/679,783, dated Sep. 12, 2017, 3 pgs.
"Advisory Action", U.S. Appl. No. 14/002,766, dated Sep. 25, 2017, 3 pgs.
"Advisory Action", U.S. Appl. No. 12/679,755, dated Apr. 17, 2015, 4 pgs.
"Examination Report Under Section 18(3)", U.S. Appl. No. 14/650,380, dated Nov. 1, 2016, 4 pgs.
"Examiner's Answer to Appeal Brief", U.S. Appl. No. 10/556,716, dated Mar. 2, 2011, 7 pgs.
"Final Office Action", U.S. Appl. No. 12/679,755, dated Aug. 14, 2013, 11 pgs.
"Final Office Action", U.S. Appl. No. 12/281,288, dated Aug. 3, 2011, 12 pgs.
"Final Office Action", U.S. Appl. No. 12/679,783, dated Oct. 6, 2016, 12 pgs.
"Final Office Action", U.S. Appl. No. 12/679,783, dated Feb. 2, 2015, 13 pgs.
"Final Office Action", U.S. Appl. No. 14/002,766, dated Apr. 21, 2016, 15 pgs.
"Final Office Action", U.S. Appl. No. 12/679,783, dated May 3, 2016, 16 pgs.
"Final Office Action", U.S. Appl. No. 14/002,766, dated Jun. 20, 2017, 17 pgs.
"Final Office Action", U.S. Appl. No. 10/624,202, dated Jun. 24, 2005, 5 pgs.
"Final Office Action", U.S. Appl. No. 11/538,759, dated Apr. 21, 2008, 6 pgs.
"Final Office Action", U.S. Appl. No. 10/556,716, dated Nov. 13, 2008, 6 pgs.
"Final Office Action", U.S. Appl. No. 11/2245,484, dated Dec, 22, 2008, 6 pgs.
"Final Office Action", U.S. Appl. No. 12/679,755, dated Mar. 11, 2011, 8 pgs.
"Final Office Action", U.S. Appl. No. 14/650,380, dated May 2, 2017, 8 pgs.
"Final Office Action", U.S. Appl. No. 15/123,826, dated Jun. 11, 2018, 9 pgs.
"Final Office Action", U.S. Appl. No. 11/538,759, dated Jul. 10, 2009, 9 pgs.
"Final Office Action", U.S. Appl. No. 12/679,755, dated Oct. 28, 2014, 9 pgs.
"Foreign Office Action", EP Application No. 08806393.8, dated Apr. 4. 2014, 5 pgs.
"International Search Report and Written Opinion", PCT Application No. PCT/GB2015/052768, dated Jan. 5, 2016, 10 pgs.
"International Search Report and Written Opinion", PCT Application No. PCT/GB2015/052766, dated Jan. 5, 2015, 14 pgs.
"Non-Final Office Action", U.S. Appl. No. 12/679,755, dated Jul. 2, 22205, 10 pgs.
"Non-Final Office Action", U.S. Appl. No. 12/679,755, dated Dec. 19, 2012, 10 pgs.
"Non-Final Office Action", U.S. Appl. No. 15/467,625, dated Feb. 2, 2018, 10 pgs.
"Non-Final Office Action", U.S. Appl. No. 12/679,783, dated Oct. 6, 2016, 11 pgs.
"Non-Final Office Action", U.S. Appl. No. 14/002,766, dated Sep. 23, 2015, 12 pgs.
"Non-Final Office Action", U.S. Appl. No. 12/679,783, dated Apr. 11, 2014, 14 pgs.
"Non-Final Office Action", U.S. Appl. No. 12/679,783, dated Sep. 11, 2015, 14 pgs.
"Non-Final Office Action", U.S. Appl. No. 12/281,288, dated Nov. 12, 2010, 15 pgs.
"Non-Final Office Action", U.S. Appl. No. 14/002,766, dated Jan. 26, 2017, 21 pgs.
"Non-Final Office Action", U.S. Appl. No. 10/624,202, dated Feb. 8, 2005, 4 pgs.
"Non-Final Office Action", U.S. Appl. No. 10/382,730, dated Jun. 17, 2004, 4 pgs.
"Non-Final Office Action", U.S. Appl. No. 11/538,759, dated Sep. 30, 2008, 4 pgs.
"Non-Final Office Action", U.S. Appl. No. 10/624,202, dated Jan. 13, 2006, 5 pgs.
"Non-Final Office Action", U.S. Appl. No. 10/556,716, dated Apr. 28, 2009, 5 pgs.
"Non-Final Office Action", U.S. Appl. No. 10/624,202, dated May 19, 2004, 5 pgs.
"Non-Final Office Action", U.S. Appl. No. 10/556,716, dated May 15, 2008, 6 pgs.
"Non-Final Office Action", U.S. Appl. No. 11/538,759, Sep. 4. 2007, 6 pgs.
"Non-Final Office Action", U.S. Appl. No. 11/538,759, dated Jan. 29, 2010, 7 pgs.
"Non-Final Office Action", U.S. Appl. No. 11/245,484, dated May 1, 2008, 7 pgs.
"Non-Final Office Action", U.S. Appl. No. 12/679,755, dated Aug. 12, 2016, 8 pgs.
"Non-Final Office Action", U.S. Appl. No. 11/830,111, dated Aug. 29, 2011, 8 pgs.
"Non-Final Office Action", U.S. Appl. No. 15/123,826, dated Oct. 2, 2017, 8 pgs.
"Non-Final Office Action", U.S. Appl. No. 12/679,755, dated Jan. 29, 2014, 9 pgs.
"Non-Final Office Action", U.S. Appl. No. 15/512,779, dated Jan. 12, 2018, 9 pgs.
"Non-Final Office Action", U.S. Appl. No. 15/512,804, dated Nov. 27, 2017, 9 pgs.

(56) References Cited

OTHER PUBLICATIONS

"Non-Final Office Action", U.S. Appl. No. 12/679,783, dated May 22, 2013, 9 pgs.
"Notice of Allowance", U.S. Appl. No. 12/679,755, dated Feb. 22, 2017, 8 pgs.
"Notice of Allowance", U.S. Appl. No. 12/679,783, dated Nov. 14, 2017, 8 pgs.
"Notice of Allowance", U.S. Appl. No. 14/650,380, dated Jul. 6, 2017, 8 pgs.
"Notice of Allowance", U.S. Appl. No. 14/002,766, dated Oct. 30, 2017, 9 pgs.
"Partial Search Report", EP Application No. 17167956, dated Oct. 30, 2017, 3 pgs.
"Preinterview First Office Action", U.S. Appl. No. 14/650,380, dated Feb. 3, 2017, 5 pgs.
"Preliminary Report on Patentability", PCT Application No. PCT/GB2007/000756, dated Sep. 2, 2008, 8 pgs.
"Requirement for Restriction/Election", U.S. Appl. No. 14/650,380, dated Nov. 14, 2016, 7 pgs.
"Search Opinion", EP Application No. 17167956.6, dated Oct. 30, 2017, 4 pgs.
"Search Report", PCT Application No. PCT/GB2008/003229, dated Jan. 16, 2009, 3 pgs.
"Search Report", GB Application No. 1605418.1, dated Aug. 17, 2017, 3 pgs.
"Supplemental Notice of Allowance", U.S. Appl. No. 14/002,766, dated Nov. 15, 2017, 5 pgs.
"Written Opinion", PCT Application No. PCT/GB2007/000756, dated Feb. 9, 2008, 7 pgs.

* cited by examiner

FLOOD PREVENTION APPARATUS

FIELD OF THE INVENTION

The invention relates to an external overflow device for use with sanitary ware, such as baths and the like. In particular, the invention relates to an overflow device operable to regulate a maximum water level in the bath or the like, thereby providing a flood prevention apparatus.

BACKGROUND TO THE INVENTION

Sanitary-ware such as baths and sinks conventionally have an overflow opening or channel in the wall of the bowl or tub. The position of the overflow determines the maximum level to which water can be contained in the bathtub or sink bowl. Typically, the overflow is an opening which provides an outlet for excess water, such that flooding by overfilling the sink or the bath can be averted. The opening is generally connected to a waste system either by means of a channel formed in the body of the sink or bath or by means of a flexible hose interconnecting an overflow terminal and a terminal on the waste system.

Such overflow systems are simple and well understood, but they do have some disadvantages. An overflow channel within the body of the bath or sink adds complexity to the structure and to the manufacturing process. A separate flexible hose arrangement uses a number of components and can be awkward to install and maintain. In addition, the waste opening in the wall of the bath or the sink presents potential hygiene problems and can be difficult to clean. In addition, the connection of the opening to the waste system may not be sized appropriately to remove the water at a sufficient rate to avoid the bath or sink overflowing thereby causing potential flooding.

Progress has been made where concealed or external overflow arrangements are being used such that a hole through the body of a sink or bath is no longer required. Such arrangements connect an overflow system to a trap connected to the waste outlet of the bath or sink.

In a commercial setting, for example in a hotel, overfilling a bath can be problematic, where bathrooms can be flooded if the bath is overfilled at great expense to the hotel owners. Therefore, using an external overflow can regulate the maximum fill level of a bathtub such that expensive repairs due to flooding and water damage can be avoided in a commercial setting; such repairs may run into thousands of pounds. Similarly, the risk of flooding also applies in a domestic setting, for example in a family bathroom. Therefore, better control of the maximum water level in a bathtub is desired.

SUMMARY OF THE INVENTION

A first aspect of the present invention provides an overflow apparatus for a bath or the like, the overflow apparatus comprises:

a first pipe section configured to attach to a first outlet port of a multi chamber waste trap, wherein the first pipe section comprises a first substantially vertical pipe section; and a second pipe section extending from a second outlet port of a multi chamber waste trap, wherein the second pipe section includes a second substantially vertical pipe section, wherein the first and second pipes are joined in continuous fluid communication by an inverted U-shaped passage, which includes a constantly open air valve at its summit, wherein the air valve is operable to control flow of water through the overflow system in a non-siphonic state.

An apparatus according to embodiments of the present invention takes the overflow out of the bath whilst allowing the level of the water in the bath to be safely and consistently regulated. Accordingly, the present invention provides an external overflow system, where the overflow system is arranged to regulate the water level in the bath, is situated external to the bath, such that if the water level exceeds a predetermined maximum level the excess water will be removed.

The permanently open air valve prevents the overflow system siphoning whole contents of the bath. Therefore, an overflow apparatus according to the present invention manages the water level in a bath to a maximum predetermined level as per regulation or as set by the level of the overflow system and also acts as a flood prevention mechanism.

The overflow system may comprise vertical adjustment, such that the maximum level attainable inside the bath is adjustable.

The overflow system may further comprise a deflector member operable to directionally guide fluid flow from the first pipe section to the second pipe section in the event that excess water needs to be drained from the sanitary ware product to which the overflow device is connected.

The deflector member may include a baffle member, which in use is located between the air valve and the U-shaped passage such that water is not in direct contact with the air valve.

The inverted U-shaped passage may be provided in a correspondingly U-shaped pipe section.

The U-shaped pipe section may include a branch portion adjacent to the air valve, wherein the deflector and baffle element are receivable in the branch portion. As such the deflector and baffle member may be removed for ease of cleaning the U-shaped passage.

The deflector and baffle member are operable to prevent direct contact between the air passing through the valve and fluid flowing through the pipes that provide the overflow system.

The provision of a constantly open air valve is such that a siphoning effect is not created within the overflow system. The valve may be operable to close should water enter the valve. The configuration of the overflow system is such that water flow through the overflow system ceases when the water level of the bath and the water level in the first pipe are equalised.

The overflow apparatus may further comprise telescopic vertical pipe sections. Accordingly, the maximum level of water in the bath tub may be adjustable or can be set to a maximum level. As such, the present invention provides a versatile overflow device that can be attached to products of varying sizes externally and if required in a concealed manner such that visible overflow openings through the sanitary ware are no longer required.

The telescopic vertical section may comprise a pipe within a pipe arrangement, wherein the pipes can slide relative to each other to extend or reduce the length of the vertical pipe sections.

A further aspect of the present invention provides a waste trap, in the form of a multi chamber drain, for a bath or the like, the waste trap comprising:

a body defining at least a first and a second chamber therein;

a first outlet port and a second outlet port each defined by openings into the body, wherein each of the first and second outlet ports are vertically and horizontally displaced relative to each other; and wherein the first outlet port is in fluid communication with the first chamber and the second outlet port is in fluid communication with the second chamber and wherein the first and second outlet ports are each connectable to an associated pipe section of an overflow system.

Under a bath tub space is limited, therefore the waste trap associated with the overflow system is configured to be compact in height. The height of the waste trap is compact due to the arrangement of the chambers defined within the body and the arrangement of the first and second outlet ports. The position of each of the first and second outlet ports is such that the centre of each outlet port is displaced horizontally and vertically relative to the other. Therefore, the vertical dimension of the trap can be minimised.

The body and the first chamber are connectable to an outlet of a sanitary ware product, for example a bath, wherein an inlet to the first chamber is provided by the outlet of the sanitary ware product. The first chamber is in direct fluid communication with the outlet of the sanitary ware product.

The position of each of the first and second outlet ports may be such that the centre of each outlet port is displaced horizontally and vertically relative to the other.

The waste trap may further comprise a partition within the body, wherein the partition defines separation of the first chamber from the second chamber, the partition includes an opening such that the first and second chambers are in direct fluid communication when the opening is open.

The waste trap may further comprise a closure member, which can be engaged with the opening or disengaged from the opening such that when the closure member is engaged with the opening direct fluid communication between the first and second chambers is disabled and when the closure member is disengaged from the opening direct fluid communication between the first and second chambers is enabled.

The closure member may comprise a seal operable to sealingly engage with a face of the partition about the opening to close the opening.

The closure member may comprise, for example a clicker seal operable by displacement of the seal to engage with the opening in the partition between the first and second chambers. The clicker seal may operate by application of pressure to displace the closure member into sealing engagement with the opening and by pressure being applied to displace the closure member out of sealing engagement from the opening.

Upon initially filling the bath with water, whilst the closure member is engaged with the opening, a first vertical pipe of an overflow system will be primed with water to the level of water in the bath. As the water level in the bath increases the closure member effectively acts as a conventional plug, but one which is offset from the bath outlet such that fluid entering the bath is in constant direct fluid communication with the first chamber.

The waste trap may further comprise a third chamber.

The first and second chambers may be horizontally oriented and the third chamber may be vertically oriented.

The third chamber may be in fluid communication with the second chamber.

The third chamber may be a vertical chamber, which is open at the bottom and in fluid communication with the second chamber, wherein the second chamber is located below the first chamber.

The third chamber may comprise a third outlet port arranged to remove excess water to waste.

The third chamber may provide a water seal.

The third outlet port may be located at least 50 mm above the lowest point of the waste trap.

A further aspect of the present invention provides an overflow apparatus for a bath or the like, the overflow apparatus comprises:

a first pipe section, which in use extends from a first outlet port of a multi chamber drain, wherein the first pipe section comprises a first substantially vertical pipe section; and a second pipe section which in use extends from a second outlet port of a multi chamber drain, wherein the second pipe section includes a second substantially vertical pipe section, wherein the first and second pipes are joined in continuous fluid communication by an inverted U-shaped passage, which includes a constantly open air valve at its summit, wherein the air valve is operable to control flow of water through the overflow system in a non-siphonic state.

An apparatus according to embodiments of the present invention takes the overflow out of the bath whilst allowing the level of the water in the bath to be safely and consistently regulated. Accordingly, the present invention provides an external overflow system and waste trap, where the overflow system is arranged to regulate the water level in the bath such that if the water level exceeds a predetermined maximum level the excess water will be removed. The permanently open air valve prevents the overflow system siphoning whole contents of the bath. Therefore, an overflow apparatus according to the present invention manages the water level in a bath to a maximum predetermined level as per regulation or as set by the level of the overflow system. The overflow apparatus also provides a flood prevention mechanism.

The overflow apparatus may further comprise a deflector member operable to directionally guide fluid flow from the first pipe section to the second pipe section in the event that excess water needs to be drained from the system.

The deflector member may include a baffle member, which in use is located between the air vent and the U-shaped passage such that water is not in direct contact with the air vent.

The inverted U-shaped passage may be provided in a correspondingly shaped pipe section.

The U-shaped pipe section may include a branch portion adjacent to the air valve, wherein the deflector and baffle element are receivable in the branch portion. As such the deflector and baffle member may be removed for ease of cleaning the U-shaped passage.

The deflector and baffle member are operable to prevent direct contact between the air passing through the valve and fluid flowing through the pipes that provide the overflow system.

The provision of a constantly open air valve is such that a siphoning effect is not created within the overflow system. The configuration of the overflow system is such that water flow through the overflow system ceases when the water level of the bath and the water level in the first pipe are equalised.

BRIEF DESCRIPTION OF THE DRAWINGS

Embodiments of the present invention will now be described with reference to the accompanying drawings in which.

DETAILED DESCRIPTION

Figure 1:
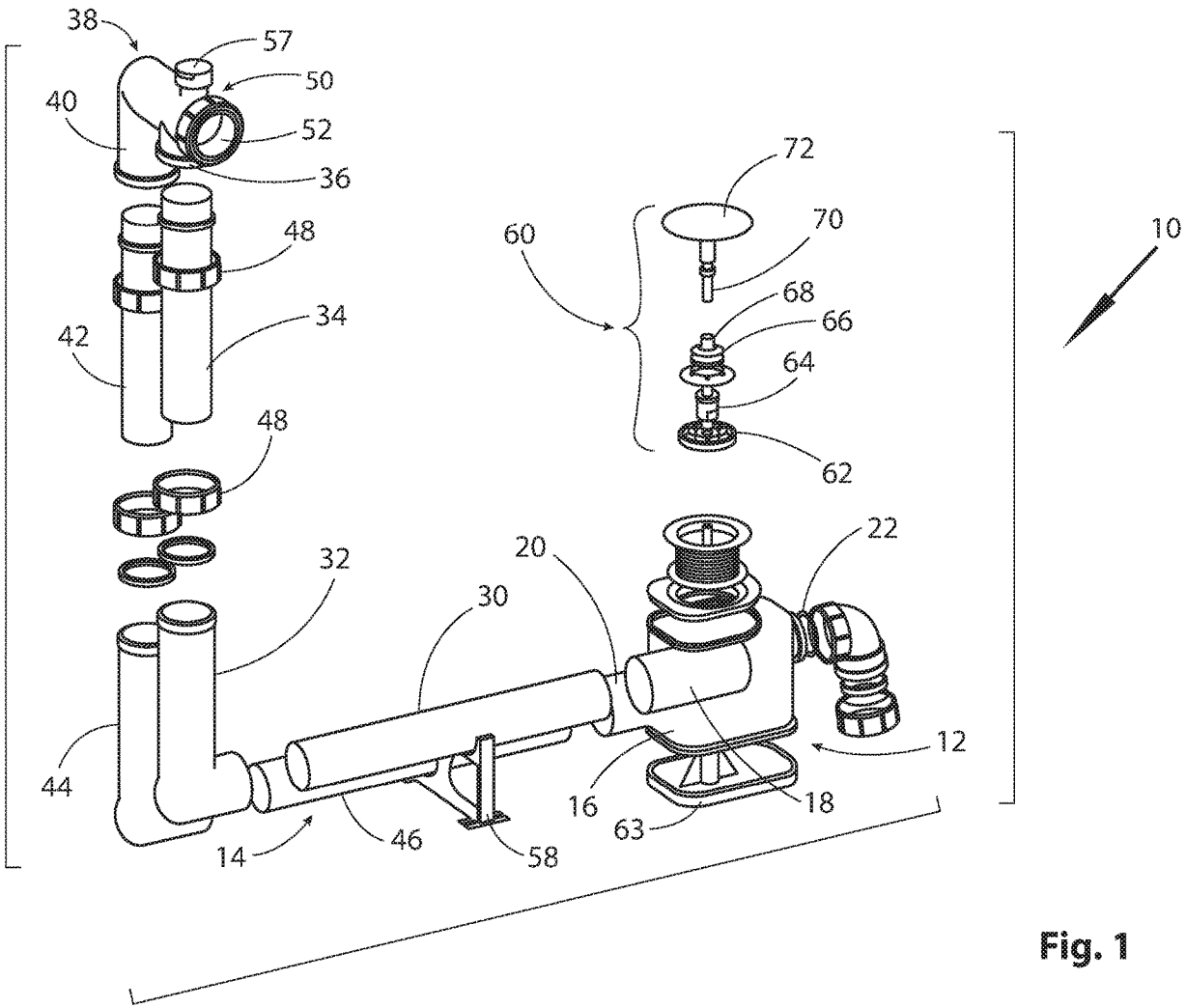
FIG. 1 is a schematic representation of an exploded perspective view of an overflow apparatus according to an embodiment of the present invention.

FIG. 1 illustrates an exploded, perspective view of an overflow device 10 according to an embodiment of the present invention. The overflow device 10 includes a waste trap 12 and an overflow system 14.

In the illustrated example, the waste trap 12 includes a body 16, which includes three outlet ports 18, 20, 22. The body 16 encases two horizontal chambers 24, 26 and a vertical chamber 28 (see FIG. 2). The arrangement of the chambers 24, 26, 28 will be discussed further below with reference to FIG. 2.

The first outlet port 18 extends through the body 16 from a first horizontal chamber 24 and the second outlet port 20 extends through the body 16 from a second horizontal chamber 26. The third outlet port 22 extends through the body 16 from a third, vertical chamber 28.

The waste trap 12, configured according to an embodiment of the present invention, provides a compact unit, suitable for use in a location where there is restricted height between the underside of a bath and the floor/surface upon which the bath is mounted/supported.

In the illustrated example, the depth/height of the waste trap 12 is smaller than conventional waste traps due to the relative positions of the first and second outlet ports 18, 20. Both the first and second outlet ports 18, 20 extend from one face of the body 16 and each outlet port 18, 20 is displaced vertically and horizontally relative to the other such that the height/depth of the waste trap 12 can be as small as possible in order to fit into a restricted space under a bath, in the vicinity of the outlet/plughole. This arrangement of first outlet 18 and second outlet 20 also allows for relatively large bore pipes to be used such that the drainage of excess water can be done as relatively high-flow, reducing the likelihood that a siphon effect will be created.

The waste trap 12 may or may not include a water seal. In the illustrated example, the minimum height of the waste trap 12 is determined by the minimum depth of water seal required. In the illustrated example, a vertical chamber 28 is provided in the waste trap 12. The provision of the vertical chamber 28 creates a water seal.

The third outlet port 22 extends through the body 16 from the vertical chamber 28. The third outlet port 22 is located at a height, which ensures an adequate water seal is maintained. In the illustrated example, the water seal is provided by the chamber 28, which is at least 50 mm deep. The third outlet port 22 is connected by suitable pipe connections 23 to a drain or waste system (not illustrated).

The first outlet port 18 and the second outlet port 20 are each connected to an overflow system 14 that is made up of a number of pipe sections that are joined together to form a continuous flow path from the first outlet 18 to the second outlet 20.

Referring again to FIGS. 1 and 2, in the illustrated example a first substantially horizontal pipe section 30 connects at one end to the first outlet port 18 and at the opposite end to a first ninety-degree elbow section 32. The first elbow section 32 facilitates the change in flow direction from horizontal to vertical and facilitates the effect of removing excess water from the bath in the event that the bath is overfilled.

A first vertically oriented pipe section 34 connects the first elbow section 32 to a first leg 36 of an inverted U-shaped pipe section 38. The second leg 40 of the inverted U-shaped section 38 connects to a second vertically oriented pipe section 42. The second vertically oriented pipe section 42 connects to a second ninety-degree elbow pipe section 44. The second elbow section 44 connects at one end to a second horizontal pipe-section 46. The second end of the second horizontal pipe section 46 connects to the second outlet port 20, which extends from the second horizontal chamber 26.

In the illustrated example, each of the pipe sections are joined together by screw fittings 48.

In the illustrated example, the inverted U-shaped pipe 38 includes a substantially horizontal hollow branch 50 extending out from the first leg 36 of the U-shape pipe section 38.

Figure 3:
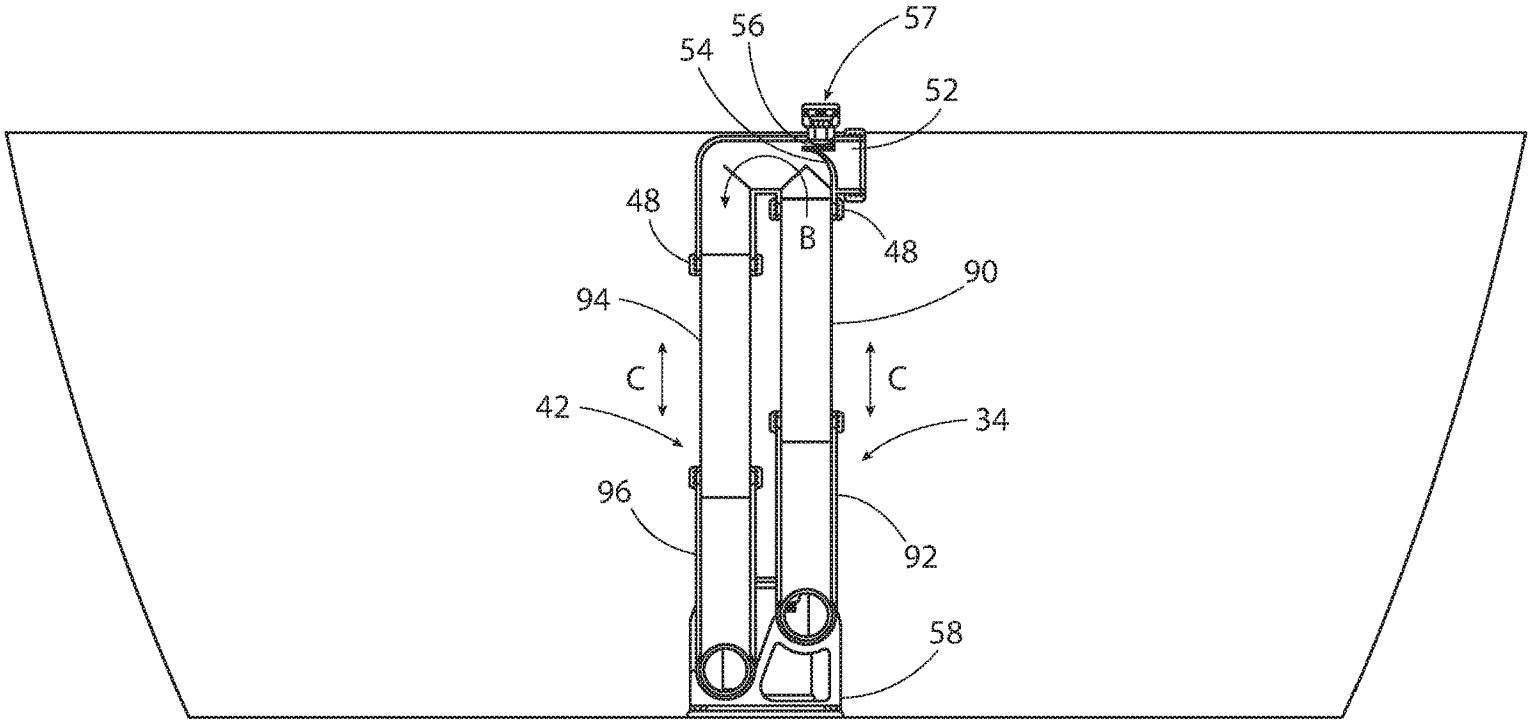
FIG. 3 is a schematic representation of a cross sectional view of the vertically oriented pipe sections as illustrated in FIG. 1.

In the illustrated example, and with reference to FIG. 3, a deflector member 52 is included within the branch 50. The deflector member 52 includes a curved surface 54, which is oriented, in use, to create a continuous U-shaped flow passage from the first outlet 18 to the second outlet 20 in the event that the bath is overfilled.

The deflector member 52 also includes a stepped baffle section 56. The stepped baffle section 56 is displaced from, but adjacent to an air valve 57 provided at the top of the inverted U-shaped pipe section 38. The baffle section 56 extends across the opening of the air valve 57 and is therefore operable to prevent air being sucked directly into the water flow as water passes through the overflow system 14.

The baffle section 56 acts as a barrier to prevent direct contact between air, entering the system via the valve 57 and water as it flows through the system. As such, the overflow device 10 according to an embodiment of the present invention operates under non-siphonic flow conditions. This means that, in the event that there is excess water in the bath, the removal of excess water will be controlled such that the bath is not inadvertently emptied as would occur if the overflow device 10 operated under siphonic conditions.

At the top of the branch 50, the air valve 57 is included to vent the flow passage to atmosphere at all times. The air valve 57 is configured to be permanently open, but is operable to prevent water escaping from the system should water enter the valve. Accordingly, the valve 57 includes a shut-off feature.

The permanently open air valve 57 acts to accelerate water flow from the first outlet 18 to the second outlet 20 in the event that excess water needs to be removed from the bath, for example in the situation where the bath is overfilled. This arrangement prevents water flowing over the sides of the bath and minimises the risk of flooding a bathroom area.

It will be appreciated that the internal bore of the pipes can be sized to allow a suitably high flow volume of water to be removed from the bath to prevent water over spilling the sides of the bath and flooding the floor below, whilst maintaining a maximum level of water in the bath. A suitable sized pipe may be 50 mm (2 inches) in diameter.

By using the overflow system 10 according to an embodiment of the present invention, complete emptying of the bath is only possible, when the first, upper, chamber 24 is in fluid communication with the second, lower, chamber 26; that is the plug element is lifted or removed.

In the illustrated example, the overflow device includes a support member 58 arranged to support the first and second horizontal pipe sections 30, 46 in a desired orientation and at a desired height such that the connections to other pipe sections 32, 44 remain secure and are not compromised as water flows through the system. Further supports or ties may be included to support or stabilise the pipe and elbow components making up the overflow device 10.

Figure 2:
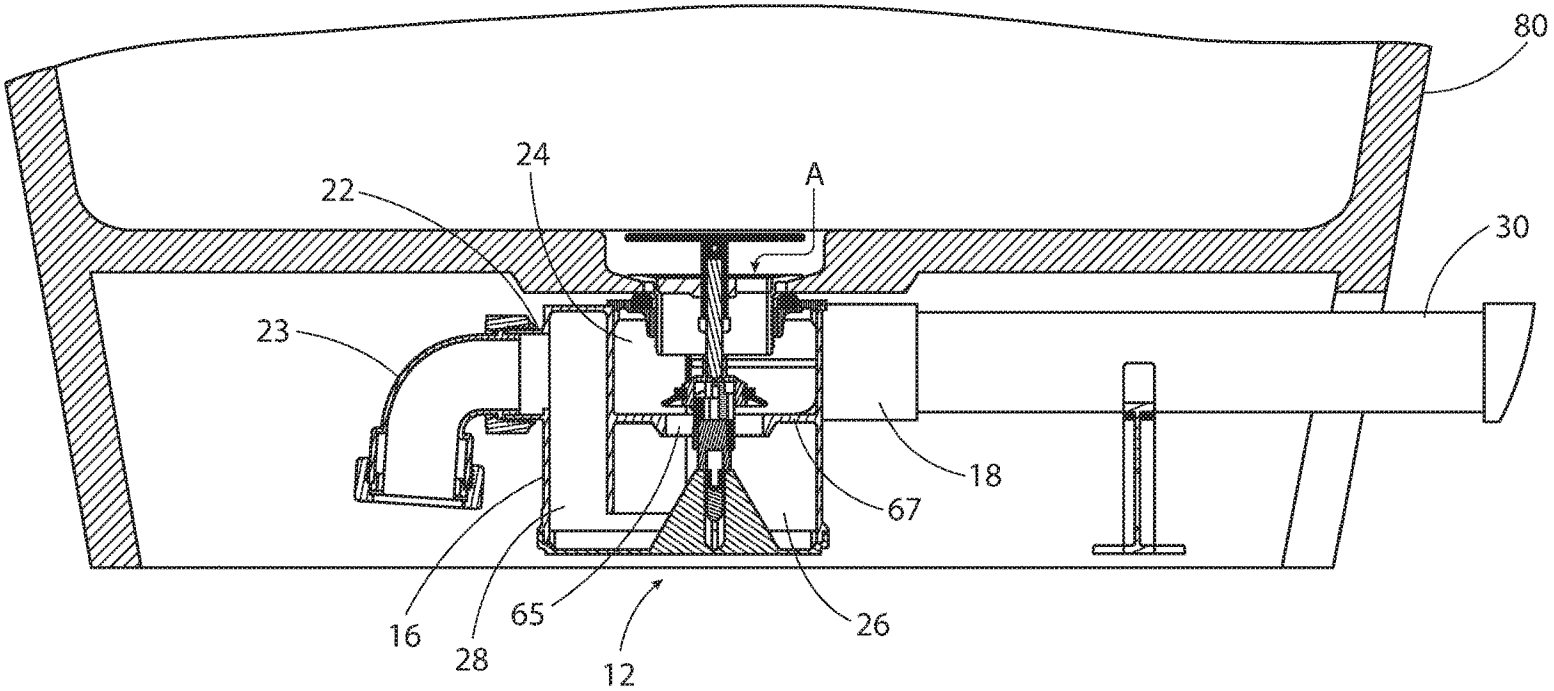
FIG. 2 is a schematic representation of cross-sectional view of a waste trap used with the overflow apparatus as illustrated in FIG. 1.

In the illustrated example, see FIGS. 1 and 2, the overflow device 10 includes a sealing mechanism that is operable to isolate the top chamber 24 from the bottom chamber 26 in order to fill the bath. An example of a suitable seal mechanism is a clicker plug mechanism 60 as illustrated in FIGS. 1 and 2.

The clicker plug mechanism 60 includes a flange 62 which locates on the base 63 of the waste trap 12. A sleeve 64 extends up from the flange 62 into which the clicker mechanism 60 is received. A closure member 66, in the form of a clicker seal 66 and a carrier 68 are connected to a rod 70, which is received in the sleeve 64. Movement of the rod 70 relative to the sleeve 64 controls the operation of the clicker seal 66 relative to the sealing face of the partition wall 67 (see FIG. 2) separating the first and second chambers 24, 26.

In the illustrated example, the clicker seal 66 engages with an opening 65 in the partition wall 67 between the first chamber 24 and the second chamber 26. When the opening 65 is closed by the clicker seal 66 direct fluid communication between the first chamber 24 and the second chamber 26 is prevented. When the opening 65 between the first chamber 24 and second chamber 26 is sealed, by the clicker seal 66, fluid flow from the first chamber 24 to the second chamber 26 is only via the overflow system of pipes 14 as described above.

The clicker mechanism includes a disc 72, which is located inside the bath and located adjacent to the outlet/plughole. The disc 72 is connected to the rod 70 such that by depressing the disc 72 the clicker seal 66 can be engaged with the opening 65 or disengaged from the opening 65.

As can be seen from FIG. 1, the appearance of the disc 72 resembles a conventional plug; however, the disc 72 does not behave as a conventional plug because whilst it covers the outlet, it never actively seals the outlet of the bath at any time. The plugging action is provided by the closure member, for example the clicker seal 66, when it is in sealing contact within the waste trap 12 as described further below with reference to FIG. 2.

FIG. 2 shows an example application of the waste trap 12 located under a bath 80. The waste trap 12 is shown as a cross-sectional representation such that only the first and third outlet ports 18, 22 are visible in FIG. 2.

FIG. 2 shows the relative placement of the first chamber 24, the second chamber 26 and the vertical chamber 28. The first chamber 24 and the second chamber 26 are both horizontal. A horizontal partition 67 separates the first chamber 24 from the second chamber 26. The partition 67 includes an opening 65, which allows fluid to flow from the first, upper, chamber 24 to the second, lower, chamber 26.

The clicker seal 66 (as described above) is configured to engage with or disengage from the opening 65 to allow or prevent direct fluid communication between the first and second chambers 24, 26. Therefore, the plug is effectively external to the bath. In addition, the overflow device 10 is also effectively external to the bath.

In the illustrated example, the opening 65 between the first and second chambers 24, 26 is open; therefore, the first and second chambers are in direct fluid communication. In this configuration, any water being put in the bath 80 shall flow directly to the waste system via the first and second horizontal chambers 24, 26, and the third, vertical chamber 28.

When the seal 66 is clicked in place, with respect to the opening 65, the first chamber 24 is isolated from the second chamber 26. As such, flow between the first chamber 24 and the second chamber 26 is prevented and the bath 80 can be filled to a maximum water level. The maximum water level in the bath is regulated by implementing the function of the overflow system as illustrated in FIGS. 1, 2 and 3.

In the illustrated example the third, vertical, chamber 28 defines a water seal, where a bottom section 75 of the vertical chamber 28 is open to the second chamber 26 such that the vertical chamber 28 and the second chamber 26 are in fluid communication. The vertical chamber 28 is also in fluid communication with a waste system (not illustrated) via the third outlet 22 which facilitates the output of water to a waste system (not illustrated).

Upon filling the bath 80, water enters the first chamber 24 via the bath outlet/plughole (Arrow A) and exits the first chamber 24 via the first outlet 16 from where it enters the first pipe section 30. As the bath 80 continues to fill with water the water level in the first vertical pipe section 34 rises correspondingly with the water level in the bath 80. The configuration of the overflow system 14, according to an embodiment of present invention, is such that the height of the first vertical pipe section 34 controls/regulates the maximum depth of water in the bath 80. Therefore, in the event that the water level in the bath 80 exceeds this predetermined maximum level, water will flow (arrow B) into the inverted U-shaped section 34 and shall be removed to the waste system via the second vertical pipe section 42, 44, the second chamber 26, the vertical chamber 28 and finally the third outlet port 18 to waste.

The predetermined maximum water level is defined by a point in the bath 80 and a corresponding height of the first vertical pipe section 34. In this manner, the water level in the bath 80 can be regulated and the risk of the bath 80 overflowing or flooding of the room containing the bath 80 can be avoided.

The vented U-shaped pipe section 34 operates such that sufficient air is drawn into the fluid flow, by the action of water flowing through the U-shape pipe, to accelerate the flow through the overflow device 10, whilst preventing a siphonic condition. The configuration of the overflow system ensures that the water level in the bath 80 is regulated to a maximum height as determined by the height of the first vertical pipe section of the overflow system. The arrangement of the constant open air valve ensures that a siphoning effect is prevented such that inadvertent emptying of the bath, whilst the seal is in place, is avoided.

By adopting the overflow system according to an embodiment of the present invention the contents of the bath can be regulated to a predetermined maximum level whilst the seal is engaged and can be emptied completely via the waste trap only when the seal is disengaged from the opening in the partition between the first and second chambers.

The maximum depth of water allowed in a bath may be regulated by a regulatory standard or it may be determined by the user. For example, in respect water conservation the user may wish to set the maximum level of water allowed in the bathtub to quite low. In this regard, an external overflow device 10 in accordance with an embodiment of the present invention may include adjustable vertical pipe sections, wherein the height of the first vertical pipe section determines the maximum level of water in the bath. The vertical pipe sections may include a telescopic pipe assembly, which allows the user or installer to adjust the height of the first vertical pipe section to a predetermined height, which represents the maximum level of water in the bath. The telescopic arrangement may include a pipe within a pipe in the vertical pipe sections, wherein the length of the vertical section can be adjusted by the inner pipe being pulled from the outer pipe in a telescopic manner.

Referring to FIG. 3, the first vertical section 34 comprises two pipe sections 90, 92 and the second vertical pipe section comprises two pipe sections 94, 96 of similar lengths to the two pipe sections 90, 92 forming the first vertical pipe section. In the illustrated example, the upper pipe section 90, 94 slides (Arrow C) within the lower pipe section 92, 96 such that the height of the overflow system is adjustable.

Alternatively, the overflow system may comprise vertical pipe sections 34, 42 of fixed height/length. For ease of installation the vertical pipe sections may be assembled as multiple parts, which may include screw fitting joints 48 as illustrated.

Whilst specific embodiments of the present invention have been described above, it will be appreciated that departures from the described embodiments may still fall within the scope of the present invention.

What is claimed is:

1. A flood prevention apparatus for a sanitary ware product such as a bath, the flood prevention apparatus comprising a multi-chamber drain and an overflow apparatus, wherein the multi-chamber drain comprises:

a body defining at least a first and a second chamber therein;

a first outlet port and a second outlet port each defined by openings through one vertical face of the body, wherein each of the first and second outlet ports are vertically and horizontally displaced relative to each other; and a third outlet port defined by an opening through another vertical face of the body, wherein the third outlet port is in fluid communication with a waste system, and with the second chamber when flow is allowed between the first chamber and second chamber, such that the third outlet port facilitates draining of the sanitary ware product to the waste system, wherein the first outlet port is in fluid communication with the first chamber and the second outlet port is in fluid communication with the second chamber and wherein the first and second outlet ports are each connectable to associated first and second pipe sections of an overflow apparatus, wherein the overflow apparatus comprises:

a first pipe section configured to attach to the first outlet port of the multi-chamber drain, wherein the first pipe section comprises a first substantially vertical pipe section; and a second pipe section configured to attach to the second outlet port of the multi-chamber drain, wherein the second pipe section includes a second substantially vertical pipe section, and wherein the first and second pipe sections are joined in continuous fluid communication by an inverted U-shaped passage, which includes a normally open air valve at its summit, wherein the air valve is operable to control flow of water through the overflow apparatus in a non-siphonic state.

2. The flood prevention apparatus as claimed in claim 1, further comprising a deflector member in a section of the inverted U-shaped passage, wherein the deflector member is operable to directionally guide fluid flow from the first pipe section to the second pipe section in the event that excess water needs to be drained from the sanitary ware product to which the flood prevention apparatus is connected.

3. The flood prevention apparatus as claimed in claim 2, wherein the deflector member includes a baffle member, which, in use, is located between the air valve and the U-shaped passage such that water is not in direct contact with the air valve.

4. The flood prevention apparatus as claimed in claim 3, wherein the inverted U-shaped passage is provided in a correspondingly U-shaped pipe section.

5. The flood prevention apparatus as claimed in claim 4, wherein the U-shaped pipe section includes a branch portion adjacent to the air valve, wherein the deflector and baffle element are receivable in the branch portion.

6. The flood prevention apparatus as claimed in claim 1, further comprising telescopic vertical pipe sections.

7. The flood prevention apparatus as claimed in claim 6, wherein the telescopic vertical pipe sections each comprises a pipe within a pipe arrangement, wherein the pipe within a pipe can slide relative to each other to extend or reduce the length of the vertical pipe sections.

8. A waste trap in the form of a multi-chamber drain for a sanitary ware product, such as a bath, the waste trap comprising:

a body defining at least a first and a second chamber therein;

a first outlet port and a second outlet port each defined by openings through a vertical face of the body, wherein each of the first and second outlet ports are vertically and horizontally displaced relative to each other; and a third outlet port defined by an opening through another vertical face of the body, wherein the first outlet port is in fluid communication with the first chamber and the second outlet port is in fluid communication with the second chamber and wherein the first and second outlet ports are each connectable to an associated pipe section of an overflow apparatus, and wherein the third outlet port is in fluid communication with a waste system, and with the second chamber when flow is allowed between the first chamber and second chamber, such that the third outlet port facilitates draining of the sanitary ware product to the waste system.

9. The waste trap as claimed in claim 8, wherein the body and the first chamber are connectable to an outlet of a sanitary ware product, for example a bath, wherein an inlet to the first chamber is provided by the outlet of the sanitary ware product.

10. The waste trap as claimed in claim 8, wherein the first chamber is in direct fluid communication with the outlet of the sanitary ware product.

11. The waste trap as claimed in claim 8, wherein the position of each of the first and second outlet ports is such that a centre of each outlet port is displaced horizontally and vertically relative to the other.

12. The waste trap as claimed in claim 8, further comprising a partition within the body, wherein the partition separates the first chamber from the second chamber.

13. The waste trap as claimed in claim 12, wherein the partition includes an opening and a closure member, which can be engaged with the opening or disengaged from the opening; and wherein when the closure member is engaged with the opening direct fluid communication between the first and second chambers is disabled and when the closure member is disengaged from the opening direct fluid communication between the first and second chambers is enabled.

14. The waste trap as claimed in claim 13, wherein the closure member comprises a seal operable to sealingly engage with a face of the partition about the opening to close the opening.

15. The waste trap as claimed in claim 13, wherein the closure member comprises a clicker seal operable by displacement of the seal to engage with the opening in the partition between the first and second chambers, wherein the clicker seal is operable by application of pressure to displace the closure member into sealing engagement with the opening and by pressure being applied to displace the closure member out of sealing engagement from the opening.

16. The waste trap as claimed in claim 8, further comprising a third chamber, wherein the first and second chambers are horizontally oriented and the third chamber is vertically oriented.

17. The waste trap as claimed in claim 16, wherein a bottom section of the third chamber is open to the second chamber such that the third chamber is in fluid communication with the second chamber.

18. The waste trap as claimed in claim 16, wherein the third chamber comprises a third outlet port arranged to remove excess water to waste, wherein the third outlet port is located at least 50 mm above the lowest point of the waste trap.

19. The waste trap as claimed in claim 16, wherein the third chamber defines a water seal.

20. An overflow apparatus for a sanitary ware product such as a bath, wherein the overflow apparatus comprises:

a first pipe section, which in use extends from a first outlet port of a multi-chamber drain, wherein the first pipe section comprises a first substantially vertical pipe section; and a second pipe section which in use extends from a second outlet port of a multi chamber drain, wherein the second pipe section includes a second substantially vertical pipe section, wherein the first and second pipe sections are joined in continuous fluid communication by an inverted U-shaped passage, which includes a constantly open air valve at its summit, wherein the air valve is operable to control flow of water through the overflow apparatus in a non-siphonic state; and a deflector member in a section of the inverted U-shaped passage, wherein the deflector member is operable to directionally guide fluid flow from the first pipe section to the second pipe section in the event that excess water needs to be drained from the sanitary ware product to which the flood prevention apparatus is connected, wherein the deflector member includes a baffle member, which, when in use, is located between the air valve and the U-shaped passage such that water is not in direct contact with the air valve, wherein the inverted U-shaped passage is provided in a correspondingly U-shaped pipe section, and wherein the U-shaped pipe section includes a branch portion adjacent to the air valve, wherein the deflector and baffle element are receivable in the branch portion.

* * * * *